United States Patent [19]

Keglewitsch

[11] 4,036,544

[45] July 19, 1977

[54] CONTACT FOR MULTIPLE CONDUCTOR CONNECTOR

[75] Inventor: Josef Keglewitsch, Addison, Ill.

[73] Assignee: Bunker Ramo Corporation, Oak Brook, Ill.

[21] Appl. No.: 654,197

[22] Filed: Feb. 2, 1976

Related U.S. Application Data

[63] Continuation of Ser. No. 515,225, Oct. 16, 1974, abandoned.

[51] Int. Cl.[2] ..... H01R 13/54

[52] U.S. Cl. ..... 339/91 R; 339/221 M

[58] Field of Search ..... 339/66 M, 75 M, 91, 339/184, 186, 198, 221 M

[56] References Cited

U.S. PATENT DOCUMENTS

| | | | |
|---|---|---|---|
| 3,523,269 | 8/1970 | Witek et al. | 339/91 R |
| 3,594,696 | 7/1971 | Witek | 339/91 R X |
| 3,671,920 | 10/1970 | Iantorno et al. | 339/221 R X |
| 3,688,243 | 8/1972 | Yamada et al. | 339/176 M X |
| 3,827,007 | 7/1974 | Fairbairn et al. | 339/91 R X |
| 3,885,850 | 5/1975 | Witte et al. | 339/91 R |

*Primary Examiner*—Roy Lake
*Assistant Examiner*—Neil Abrams
*Attorney, Agent, or Firm*—William Lohff; F. M. Arbuckle

[57] ABSTRACT

A patchcord type electrical connector assembly includes a plurality of female connector parts supported by a mounting plate in an arrangement of perpendicular rows. A male patchcord connector part carries contacts spaced to engage respective ones of a plurality of the female connector parts and includes retention nibs which are received in retention recesses in the form of bores in the housings of the female connector parts. The male patchcord connector part includes longitudinally extending ribs at the edges thereof and intermediate longitudinally extending ribs between adjacent contacts to protect the contacts. The housing of the female connector parts are shaped to receive the longitudinally extending ribs by the provision of recesses which will accept a pair of end ribs of separate male connector parts or an intermediate rib of a male connector part. The complementary structure of the male and female connector parts provides polarization for proper contact identification and engagement.

5 Claims, 6 Drawing Figures

Fig. 2
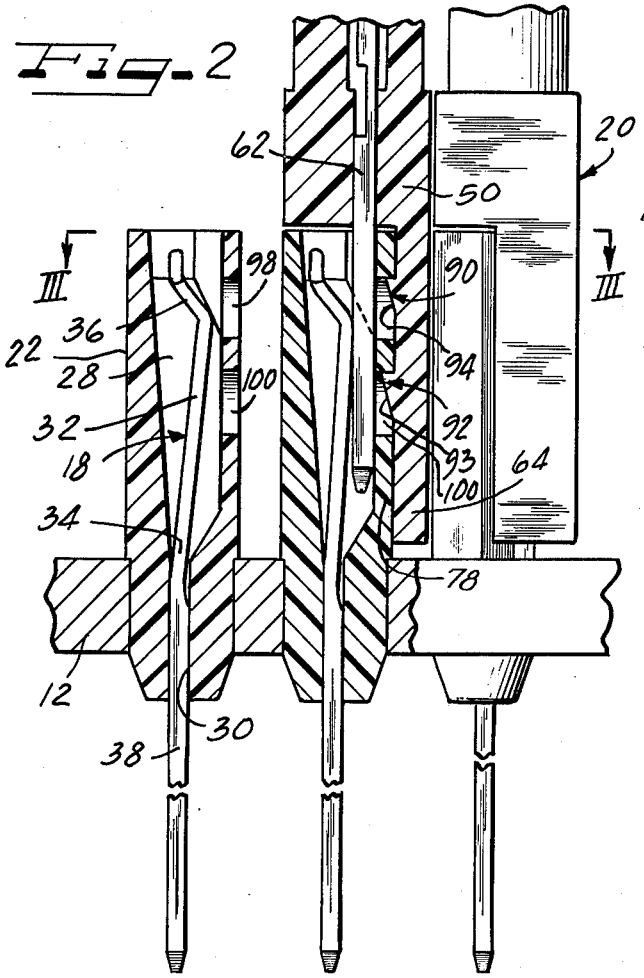
Fig. 3
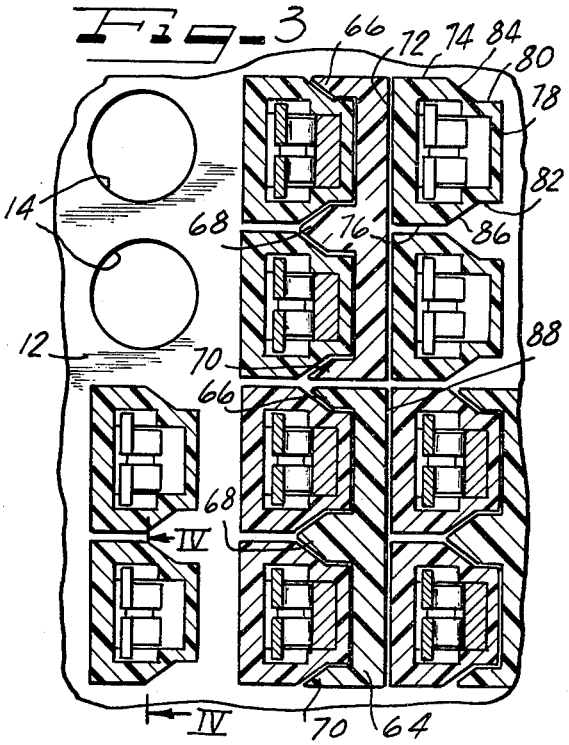
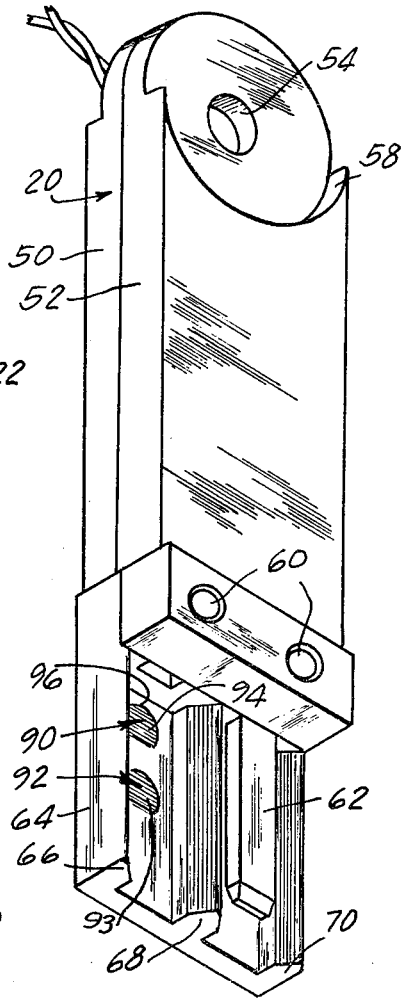
Fig. 5
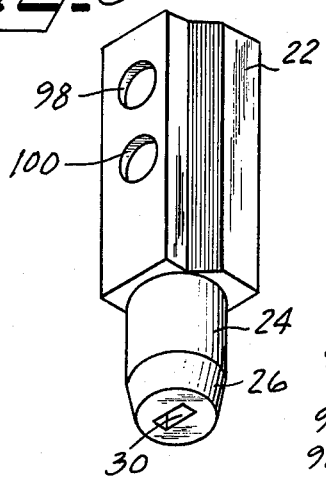
Fig. 4
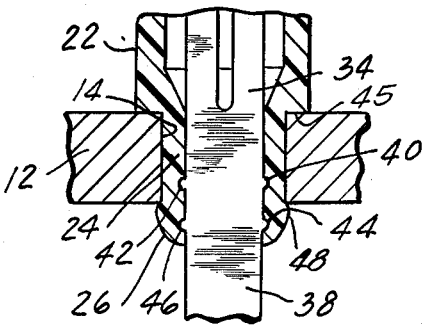
Fig. 6

CONTACT FOR MULTIPLE CONDUCTOR CONNECTOR

This is a continuation, of application Ser. No. 515,225, filed Oct. 16, 1974 now abandoned.

BACKGROUND OF THE INVENTION

1. Field of the Invention

This invention relates to electrical connector assemblies, and is more particularly concerned with electrical connector assemblies of the patchcord type wherein a first connector part, usually a male connector part is matable in releasable engagement with a plurality of second connector parts, usually female connector parts.

2. Description of the Prior Art

Patchcord connector assemblies are well known in the art. These connector assemblies usually comprise a field of individual female connectors carried by a mounting plate such that the individual contacts thereof are exposed on one side of the mounting plate for a more or less permanent type electrical connection, while the other end is protected within a housing and accessible for a plug-in type connection with a respective contact of a male connector part. The male connector parts carry a plurality of contacts, and are therefore associated with a plurality of the female connector parts.

Inasmuch as patchcord type electrical connector assemblies have, in the past, required a considerable amount of space, newer equipment has been miniaturized. Along with miniaturization, however, problems have arisen in providing sufficient retention forces between the male and female connector parts. One solution has been to provide male and female contacts which have complementary projections and recesses which are directed transversely of the direction of insertion and withdrawal. While this structure offers additional retention capabilities, high withdrawal forces which can be generated sometimes causes loosening and even complete removal of contacts as the connector parts are separated.

SUMMARY OF THE INVENTION

It is the primary object of the present invention to provide an electrical connector assembly of the patchcord type with a retention capability between the connector parts to cause effective electrical engagement between the electrical contacts, which does not utilize the electrical contacts for retention of the parts.

A more specific object of the invention is to provide an electrical connector assembly in which the matable connector parts include housing structures which are releasably engageable.

Another object of the invention is to provide polarization for proper circuit identification and connection through the provision of complementary shaped male and female housing parts.

Another object of the invention is to provide contact protection for male contacts.

These and other objects are realized by the provision of an electrical connector assembly which has an array of individual female connector parts supported in perpendicularly arranged rows on a mounting plate. Each of the female connector parts includes a housing having a contact mounted therein which is exposed on one side of the mounting plate and adapted for connection, such as by wire wrapping, to electrical circuits. The opposite end of the electrical contact is protected within the housing.

Each male connector part includes a number of male electrical contacts for engagement with a like number of the electrical contacts carried in the female connector parts. The male contacts are mounted in a housing which has an extended portion for protecting the male contacts. This protection feature includes a pair of longitudinally extending end ribs at the outboard edges of the housing and one or more intermediate ribs each extending between adjacent male contacts.

The extended portion of the male connector part housing includes at least one ramp shaped nib adjacent each male contact and having a shoulder which extends generally transverse of the direction of insertion for engagement in a recess, in the form of a bore or aperture, in the respective housing of a female connector part. Retention of the connector parts is therefore provided by engagement of the housings, rather than engagement of the contacts. Inasmuch as the housings are formed of a resilient material, such as nylon, the nib and recess structure is resiliently deformable for disengagement of the parts upon the application of a withdrawal force.

Each housing of a female connector part is provided with a shoulder for abutting one surface of the mounting plate. During manufacture, a second shoulder is provided to abut the opposite surface of the mounting plate to secure the housing to the mounting plate. This second shoulder results from a mushrooming of the housing portion which is effected by a pair of projections which extend from the electrical contact and the final positioning step of the contact within the housing after the housing has been positioned in a mounting aperture in the mounting plate. These contact projections therefore serve two purposes in securing the contact to the housing and securing the housing to the mounting plate.

BRIEF DESCRIPTION OF THE DRAWINGS

Other objects, features and advantages of the invention, together with its organization, construction and operation will be best understood from the following detailed description of a preferred embodiment thereof, taken in conjunction with the accompanying drawings, on which:

FIG. 2 is a side view of apparatus such as illustrated in FIG. 1, shown partially in section;

FIG. 3 is a top view of the electrical connector assembly of FIG. 2 taken substantially along the line III—III;

FIG. 4 is a fragmentary sectional view of a portion of the apparatus of FIG. 3 taken substantially along the line IV—IV;

FIG. 5 is a perspective view of a contact housing of the present invention; and FIG. 6 is a perspective view of an electrical connector part constructed in accordance with the principles of the present invention.

DESCRIPTION OF THE PREFERRED EMBODIMENT

Figure 1:
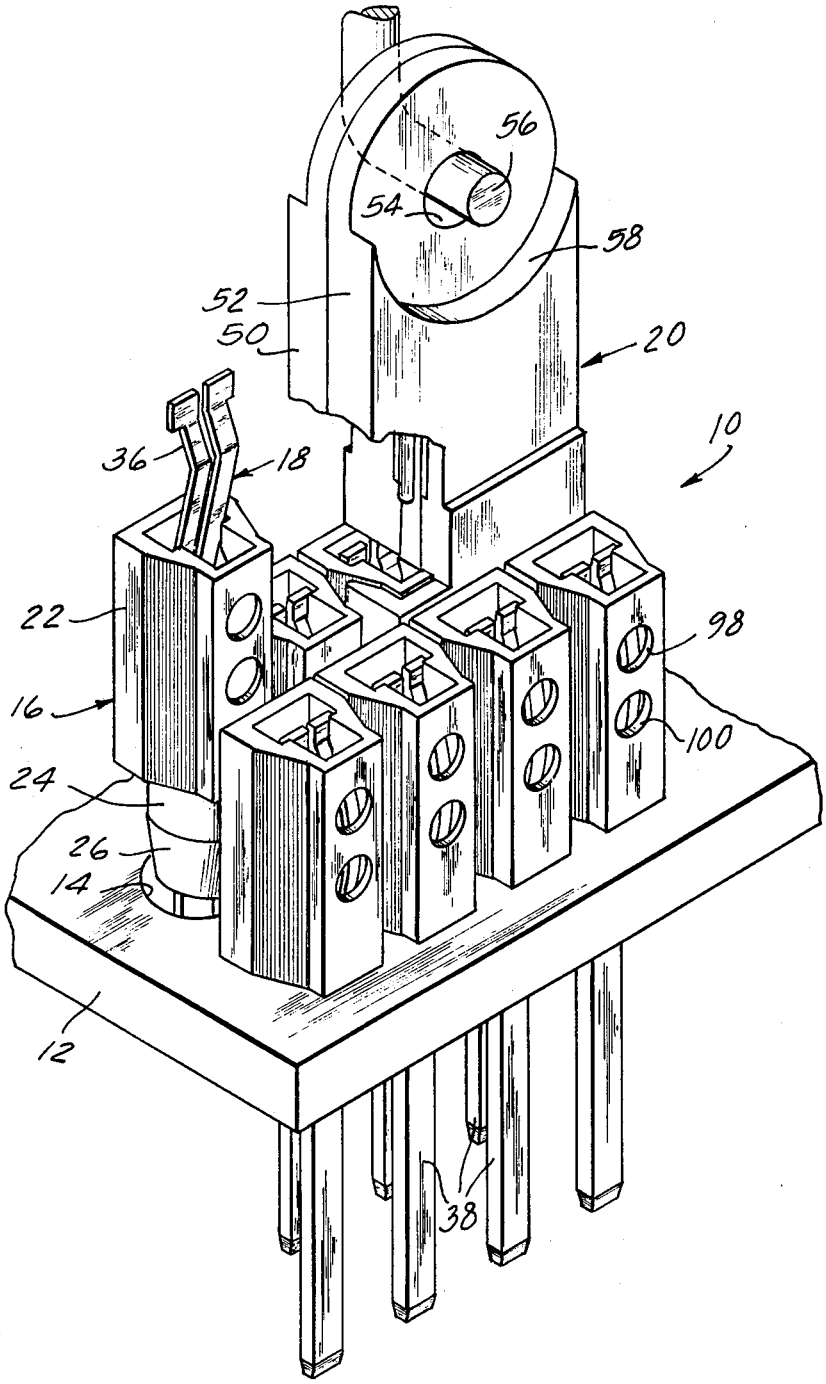
FIG. 1 is a perspective view, shown partially broken away, of an electrical connector assembly constructed in accordance with the present invention.

Referring to FIG. 1, an electrical connector assembly of the patchcord type is generally illustrated at 10 as comprising a plate 12 having a plurality of apertures 14 therein for mounting a plurality of first connector parts 16 and for supporting the first connector parts 16 in a side-by-side relationship to form groups arranged in rows.

Each of the connector parts 16 is illustrated herein as a female connector part which is matable with a male connector part 20.

Referring specifically to FIGS. 1, 2 and 4, each connector part 16 includes a contact 18 which is mounted in a housing which includes an upper housing portion 22, an intermediate portion 24, and a terminal housing portion 26. Portion 22 forms a protective wall encircling the contact 18 and the portions 24 and 26 form a contact support. In FIG. 2, the upper housing portion 22 is illustrated as including internal walls which define a cavity 28 and the intermediate and terminal housing portions 24 and 26 include internal walls which define a passageway 30. The contact 18 includes an upper portion 32 which is bent at an angle at 34 with respect to a lower portion 38 and which may include a bifurcated portion 36 for engaging a mating contact of a male connector part. The contact may therefore be said to include a flexible mating portion, a terminating portion and a mounting portion intermediate the mating and terminating portions. The mounting portion of the contact extends between the bend 34 and the point of exit of the contact from the passageway 30. In the particular example illustrated in FIGS. 1, 2 and 4, the terminating portion is constructed as a wire wrapping post.

Referring to FIG. 4 in particular, the intermediate portion of the contact 18 is illustrated as comprising two pair of projections 40, 42 and 44, 46 extending therefrom to aid in securing the contact within the housing and the housing to the mounting plate 12. During manufacture, the housing portions 24 are pressed into respective apertures 14 so that a shoulder 45 abuts the upper surface of the plate 12. The contacts 18 have been partially inserted to a point where the projections 44 and 46 are within the mounting portion 24. The contacts 18 are then pressed further into the housings to the position illustrated in FIG. 4. As the projections 44 and 46 progress beyond the lower surface of the mounting plate 12 a cold flow of material occurs to mushroom the terminal portion 26 and form a second shoulder at 48. With this structure, the contact is secured in the housing and the housing is secured to the mounting plate.

Referring to FIGS. 1, 2, 3 and 6, a cooperable modular connector part 20 is illustrated as comprising a housing including a portion 50 and a portion 52 which together include an aperture 54 for receiving a hook type removal tool generally illustrated at 56. The housing portions 50 and 52 are each recessed as indicated at 58 to permit entry of the tool 56 where a plurality of the connector parts 20 are mated to adjacent female connector parts 16. The housing portions 50 and 52 mount contacts 62 therein and are secured together by any suitable means, such as the cold form 60, or by gluing or the like. Each of the contacts 62 is, of course, connected to an electrical conductor within the housing, which conductors may exit the housing through an opening in a manner which is well known, but not illustrated in detail on the drawings.

The housing portion 50, as illustrated in FIGS. 2 and 6, extends beyond the housing portion 52 and the free ends of the contacts 62, as illustrated at 64, parallel to and spaced from the contacts 62. The extended portions 64 includes a pair of contact protection ribs 66 and 70 and an intermediate rib 68 disposed between adjacent contacts 62. In FIG. 6, the connector part 20 has been provided with space for only two contacts 62, it being understood that additional contacts could be provided. In the case of additional contacts, additional intermediate ribs 68 would also be provided. The extension beyond the contacts 62 provides contact alignment prior to mating due to the complementary structure described below.

Referring to FIG. 1, and more particularly to FIG. 3, the housing portion 22 of the connector part 16 is illustrated as comprising a plurality of outer surfaces which define an asymetrical shape or irregular polygenal cross section which is symmetrical with respect to a horizontal center line of each connector part as viewed in FIG. 3. First of all, each housing portion 22 includes a surface 72 which is aligned with like surfaces of other housings of the same vertical row of the drawing. A pair of side surfaces 74 and 76 are parallel with each other and aligned with like surfaces of other housings of the same horizontal row of the drawing, a surface 78 which is parallel to the surface 72 and aligned with like surfaces of the same vertical row of the drawing, and two pair of surfaces 80, 84 and 82, 86 which define recesses at each side of the surface 78. Inasmuch as the surface configuration of the housing is symmetrical, as noted above, the recesses intermediate or of adjacent housings are at least twice the width of a single recess. It will be noted by reference to FIGS. 3 and 6, that the intermediate rib 68 (or ribs) is twice the thickness of the end ribs 66 and 70, and that the shape of an intermediate rib 68 is complementary to adjacent recesses, while the shape of the end ribs 66 and 70 is complementary to the shape of a single recess. The extended portion 64 of the housing portion 50 also includes a surface 88 which complements a plurality of the surfaces 72 of the housing portions 22 of the adjacent, here vertical, row of connector parts 16. This complementary structure between the connector part 20 and the connector parts 16 provides polarization for the electrical connector assembly.

Referring to FIGS. 1, 2, 5 and 6, the extended portion 64 is also illustrated as comprising a plurality of ramp type nibs which extend from the extended portion 64 in the space between that portion and the contacts 62. As an example, two such nibs 90 and 92 are illustrated as having a ramp surfaces 93 and 94 and an arcuate shoulder surface 96. The nibs extend in an interference relationship with the housing portion 22 in the area of the surface 78 and snap into respective recesses, here illustrated as bores 98 and 100, as the connector part 20 is mated with a plurality of the connector parts 16. During mating, the contacts 62 engage the mating portions 36 so that the contacts are mated with a wiping motion during which the contact 18 is flexed generally in the area 34.

The mating parts of the connector housings are constructed of a material, such as nylon; therefore, the nibs are resiliently yieldable for disengagement upon the application of a suitable disengagement force by a hook type extraction tool 56.

The applicant has thus provided an electrical connector assembly 10 comprising first connector parts 16, each including a first electrical contact 18 and a housing having a protective wall 22 encircling the contact and secured in the mounting plate 12 by means of the deformation of the portion 24 on insertion of the contact. A second of modular connector part 20 is matable with one group of a plurality of groups of first connector parts arranged in a row and includes a second electrical contact 62 for mating with each first electrical contact and a guide wall or portion 50 and 64 spaced from the second electrical contact for receipt between the protective wall and the first contact of the respective housing. The guide wall 64 also fits between the protective walls of the adjacent row of first connector parts which serve to confine and guide the guide wall while the wide recesses and narrow end ribs permit a second modular connector part to engage another group of first connector parts in the same row. The contacts 62, on engaging the surface 78 (while also engaging the contacts 32), serve to bias the projecting portion or nibs 90 and 92 in an interference relationship with the surface 78 at the bores 98, 100. Thus, the spacing between wall 64 and contact 62 is such as to enable snug passage of the surface 78 therebetween and upon engagement of the contacts 32, 62, the surface 78 and wall 64 mate and engage the ribs with their respective faces.

From the foregoing description and the drawings, one skilled in the art will appreciate that an electrical connector assembly constructed in accordance with the present invention is provided with many features which satisfy the objects of the invention, features which include polarization, contact protection and patchcord retention.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electrical connector assembly comprising:

a first connector part including a first electrical contact and a first contact support for supporting said first electrical contact with a protective wall of insulating material for said first contact; and a second connector part matable with said first connector part and including a projecting second electrical contact which is matable with said first electrical contact, and a guide wall of insulating material having a portion spaced from said second electrical contact for receiving said protective wall therebetween, said second electrical contact fitting between a portion of said first electrical contact and protective wall, said guide wall including a projecting portion biased by said second electrical contact into an interference relationship with said protective wall, and said protective wall including a receiving portion which receives said projecting portion in response to a predetermined mated positioning of said contacts.

2. An electrical connector assembly comprising:

a first connector part including a first electrical contact and a first contact support for supporting said first electrical contact with a protective wall of insulating material for said first contact; and a second connector part matable with said first connector part and including a projecting second electrical contact which is matable with said first electrical contact and a guide wall of insulating material having a portion spaced from said second electrical contact for receiving said protective wall therebetween, said guide wall including a projecting portion biased by said second electrical contact, into an interference relationship with said protective wall, and said protective wall including a receiving portion which receives said projecting portion in response to a predetermined mated positioning of said contacts, said first connector part comprising an elongate housing including open ends, a first housing portion and a second housing portion, said second housing portion including a passageway communicating with one of said open ends, and said first housing portion including a chamber formed by said protective wall and communicating with the other of said open end and said passageway, and a bore in said protective wall forming a projection receiving portion, said first contact including a first portion secured in said passageway, and a second portion on said first contact which is free to flex in said chamber so that the projecting second contact is engaged on one side by said first contact second portion and at an opposite side by said protective wall.

3. The electrical connector assembly claimed in claim 2, wherein said projecting portion comprises a ramp shaped nib having an arcuate shaped shoulder to be received in and abut the wall of said bore.

4. In a matable electrical connector assembly in which a plurality of first connector parts are mated with a second connector part which is movable in a mating direction with respect to said first connector parts, and each of said first connector parts includes a first housing of insulating material and a first contact and said second connector part includes a second housing of insulating material and a plurality of second contacts each for engagement with a respective first contact, the improvement comprising:

a bore in an insulating material of each of said first housings extending substantially perpendicular to the direction of movement of said second connector part, and a plurality of ramp-shaped projections of insulating material extending from said second housing and each including a surface inclined with respect to the direction of mating and a surface perpendicular to the direction of mating, and means spacing said second contacts and housings relative said projections for biasing said ramp-shaped projections into the respective bores to releasably lock said first and second connector parts in response to the engagement of each second contact with a respective first contact.

5. An electrical connector assembly comprising:

a plate having an aperture therein, a first connector part including a first electrical contact and a first contact housing including a portion passing through said aperture in said plate for supporting said first electrical contact from said plate, a second connector part matable with said first connector part and including a second electrical contact which is matable with said first electrical contact and a second contact housing for supporting said second electrical contact, said second contact housing having a guide wall which is spaced from said second contact, a portion of said first contact housing being received therebetween, said guide wall having a projecting portion biased by said second electrical contact into an interference relationship with said first contact housing as said housings are moved relative each other to mate said first and second electrical contacts, said second electrical contact fitting between a portion of said first electrical contact and first contact housing, said first contact housing including a projection receiving portion of insulating material which receives said projecting portion in response to a predetermined mated positioning of said contact housings, wherein said first electrical contact includes a flexible mating portion for engaging said second electrical contact and a terminating portion for connection to an electrical circuit and a mounting portion intermediate said mating and terminating portions, and said first contact housing includes a shoulder abutting one surface of said plate with at least one first internal wall in said portion passing through said aperture in said plate defining a passageway for receiving said mounting portion of said first electrical contact and at least one second internal wall defining a chamber receiving said flexible mating portion of said first electrical contact, said mounting portion of said electrical contact including a plurality of projections extending into said first internal wall below said first shoulder and deforming said first internal wall to form an external shoulder abutting the other surface of said plate.

* * * * *